United States Patent [19]

Dyke

[11] 4,354,331

[45] Oct. 19, 1982

[54] COLLAPSABLE STRUCTURES

[75] Inventor: Leslie A. Dyke, Chigwell, England

[73] Assignee: Consort Project Developments Limited, London, England

[21] Appl. No.: 207,442

[22] Filed: Nov. 17, 1980

Related U.S. Application Data

[63] Continuation of Ser. No. 968,734, Dec. 12, 1978, abandoned.

[30] Foreign Application Priority Data

Dec. 15, 1977 [GB] United Kingdom ..... 52334/77

[51] Int. Cl.[3] ..... E04B 1/346

[52] U.S. Cl. ..... 52/66

[58] Field of Search ..... 52/66, 69; 312/140.2; 217/47, 48, 46; 220/16; 296/173, 176

[56] References Cited

U.S. PATENT DOCUMENTS

| | | | |
|---|---|---|---|
| 1,156,221 | 10/1915 | Focks | 217/47 |
| 2,167,557 | 7/1939 | Stout | 296/23 |
| 3,050,331 | 8/1962 | Mansen | 296/27 |
| 3,139,205 | 6/1964 | Haubrich | 217/47 |
| 3,161,433 | 12/1964 | Markel | 296/27 |
| 3,194,251 | 7/1965 | Pettersen | 135/1 |
| 3,209,373 | 10/1965 | Meredith | 4/172 |
| 3,252,469 | 5/1966 | Peake | 52/66 |
| 3,677,600 | 7/1972 | Charron | 296/27 |
| 3,766,844 | 10/1973 | Donnelly | 52/66 |
| 3,792,557 | 2/1974 | Pitts | 52/66 |

*Primary Examiner*—Price C. Faw, Jr.
*Assistant Examiner*—Henry E. Raduazo
*Attorney, Agent, or Firm*—Diller, Ramik & Wight

[57] ABSTRACT

A collapsable structure including a folding strut one end of which is pivoted to a rigid element to enable said strut to be rotated from a retracted position to an extended position, said strut having an abutment surface spaced away from the pivot and extending in a plane substantially parallel to the axis thereof, said surface being shaped to engage a co-operating engagement surface carried on said rigid element to locate said strut in its extended position, and releasable means for causing said surfaces to be held in contact with each other.

18 Claims, 21 Drawing Figures

FIG. 2
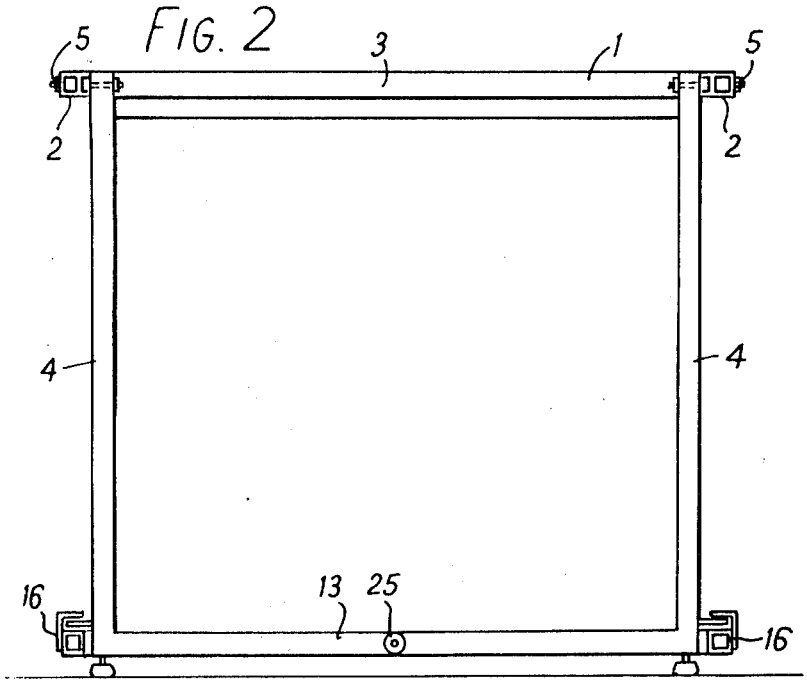
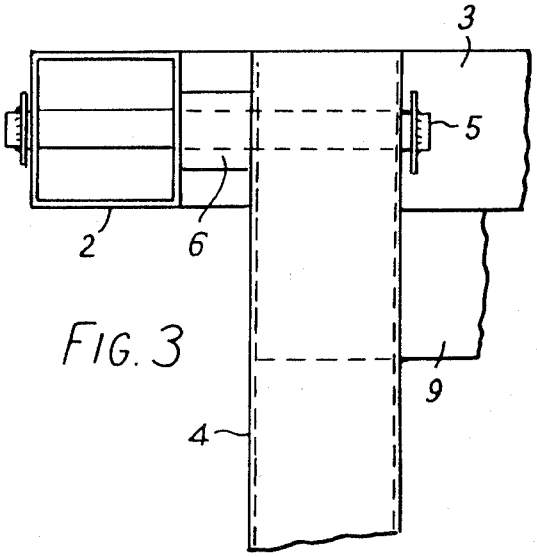
FIG. 3
FIG. 4
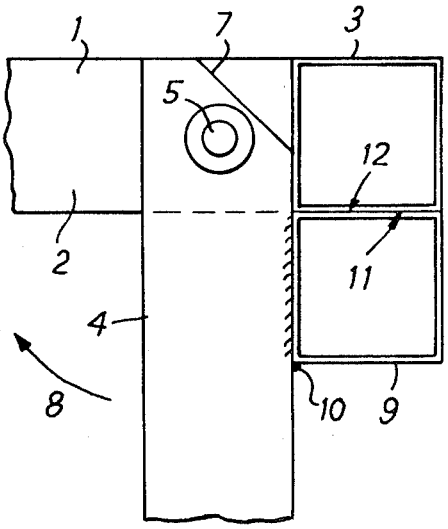

COLLAPSABLE STRUCTURES

This application is a continuation, of application Ser. No. 968,734, filed Dec. 12, 1978.

This invention relates to collapsable structures and is intended to provide a structure which can be extended from a retracted state but which will be substantially more rigid than known types of structures of this kind.

The fundamental disadvantage with collapsable structures which employ one or more folding struts which are connected by a pivot to a rigid element is the inherent shake in the pivot joint. Even if the end of the folding strut remote from the pivot is rigidly clamped to some other member the shake in the pivot remains. This disadvantage is particularly noticeable in collapsable tables and items employing similar folding frameworks and is a major disadvantage especially if the tables are to be used for commercial purposes such as for counters in a trading establishment or other working surface. The shake in the structure proving a constant irritation and frequently making the structures dangerous, especially if used in a public place.

A structure which can be folded to a small size but yet which can be extended to provide an article of furniture such as a counter or display apparatus has many applications as many units can be used in combination and it enables articles such as counters to be rapidly installed and interchanged into new layouts, disposed of when not required and easily stored, and large numbers of them can be carried in existing vehicles.

According to the present invention a collapsable structure includes a folding strut one end of which is pivoted to a rigid element to enable said strut to be rotated from a retracted position to an extended position, said strut having an abutment surface spaced away from the pivot and extending in a plane substantially parallel to the axis thereof, said surface being shaped to engage a co-operating engagement surface carried on said rigid element to locate the strut in its extended position, releasable means causing said surfaces to be held in contact with each other.

Thus, the abutment surface and the engagement surface when held together form, with the pivot a relatively rigid assembly and help to obviate the shake usually associated with such pivoted joints.

In one preferred arrangement the abutment surface is provided on an abutment projecting from the strut although, if required it can be provided directly on the strut itself in certain configurations.

Preferably two folding struts are included which are both connected to the rigid element at spaced apart points and which pivot about axes which are co-axial.

Thus, these two folding struts could, for example, be two of the legs of a collapsable 'working-surface' or they could be two end members of part of a space frame, other similar members being provided at the other end of the frame if required. Such a space frame has many uses, it can be utilised as the outer assembly for a collapsable frame within which garments may be hung, it can be provided with an outer covering to provide storage facility or for many other uses besides, as mentioned above being used as the framework for articles of furniture such as a display or counter unit.

When the two folding struts are provided as mentioned above a rigid connecting member can be included which extends between them and on which the abutment surfaces for both struts are formed. With this arrangement any "end" shake also tends to be eliminated because the two struts are rigidly connected together and as the abutment surfaces on the connecting member the whole pivot jointed structure can be rigidly locked up.

If desired a portion of the rigid element extending between the pivots can be shaped to provide an engagement surface for co-operation with the abutment surfaces on the connecting member.

In any case, the abutment surfaces on the connecting member can be arranged to face in a reciprocal direction to the lengthwise direction of the struts away from the pivots or alternatively they can be arranged to face in a direction substantially normal to the lengthwise direction of the struts away from the pivots depending upon where it is desired to provide the engaging surfaces in relation to the pivot. This position will be determined as is most convenient in the structure concerned.

In a preferred arrangement the rigid element is in the form of a panel or frame having four folding struts which can be pivoted to extend to extended positions to extend from one side thereof and which are arranged at the corners of a regular figure having opposed parallel sides and the axes of the pivotal connections between the struts and the element being coaxial or parallel.

With this arrangement a second element may be provided to which points on the pivotal struts spaced away from the pivot points are connected or are adapted to be connected to provide when assembled a three dimensional structure. This structure is thus formed from the panel or frame, the four folding struts projecting from it and the second element which, if desired can also be in the form of a rigid frame.

When applied to, for example, a table therefore the table top can be connected or provide the panel or frame which forms the rigid element, the four struts could form the legs and the second element would form a lower frame attached to the lower portions of the legs when the table is in use. When the table is collapsed the lower frame can be completely removed when the legs are folded upwardly.

Preferably however the second element carries at least part of the releasable means for causing the apparatus's operative surfaces to be held in contact with each other and thus provides a convenient way of achieving the close contact required.

As mentioned above the second element may comprise a frame or panel and if so said struts may be connected by sliding attachments, the releasable means extending between said frame and said struts to enable them to be rigidly connected together when the struts are in their extended positions. With this arrangement therefore when the releasable means are disconnected the struts can be folded towards the first rigid element and the second element will also move towards the first element, the overall thickness of the combined collapsed frame being merely the thickness of the two elements.

In a convenient construction the frame or panel which provides the second element includes channels in which pins formed in the struts can slide.

With this arrangement the struts are preferably arranged in pairs, each pair having co-axially spaced apart pivotal axes and having a connecting bar extending between them which carries releasable means for connection to the second element.

If desired a safety brace may be provided between each strut and said second element, the brace being pivoted to the strut and being arranged to have a sliding connection with the second element, and means for locking the brace in relation to the second element when the extended position of the strut is achieved. This brace therefore acts as a safety measure and also assists in providing a rigid lock-up.

Resilient stop means may also be provided which extend between the brace and the second element and which can be manually over-ridden when the strut is extended but which will retain it in a intermediate position or positions if required. This resilient stop therefore acts as a safety device so that if, for any reason, the various parts of the structure have to be dropped during assembly the resilient stop means will hold them in approximately the position in which they are abandoned and would not allow the whole structure to collapse.

The invention can be performed in many ways and a number of embodiments will now be described by way of example and with reference to the accompanying drawings in which:

FIG. 2 is a cross-sectional elevation on the lines II—II of FIG. 1;

FIG. 3 is an enlarged view of part of the structure shown in FIG. 2;

FIG. 4 is a side elevation of the detail shown in FIG. 3;

Figure 1:
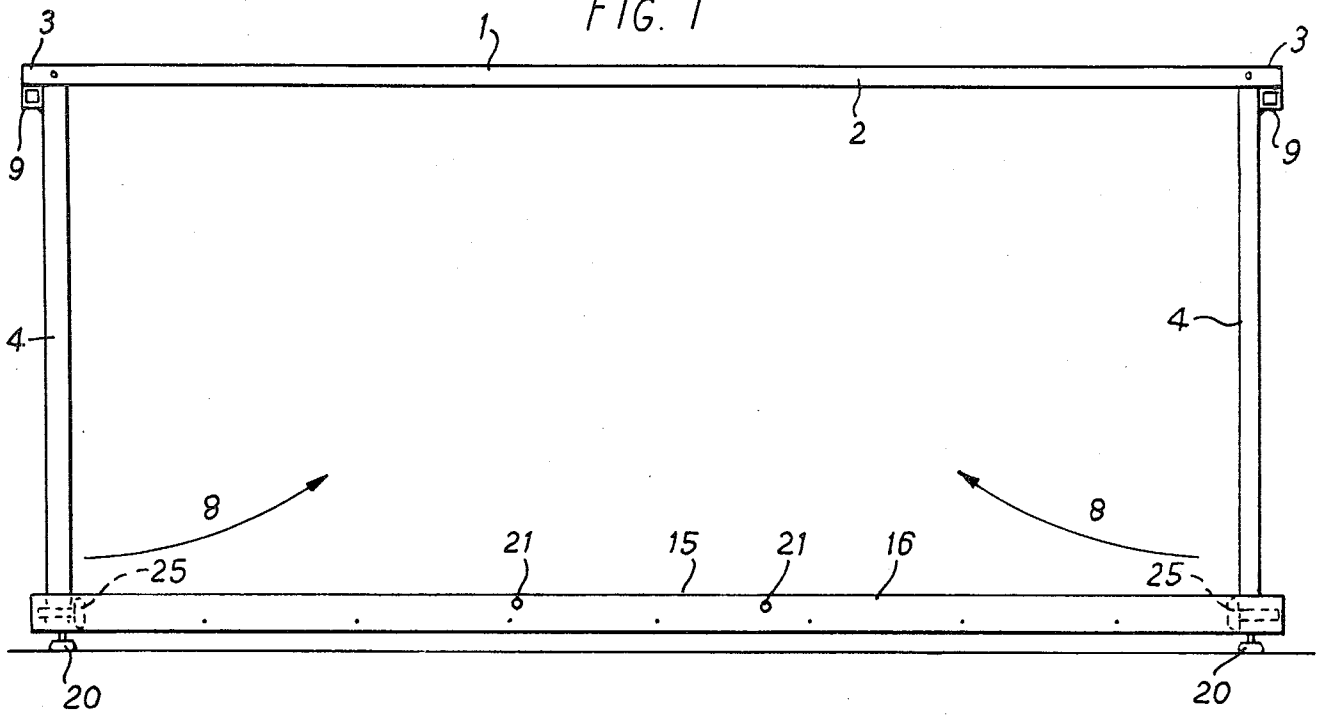
FIG. 1 is a front elevation of a structural assembly which is intended for use with a knock-down counter unit; - or other 'working surface'
Figure 5:
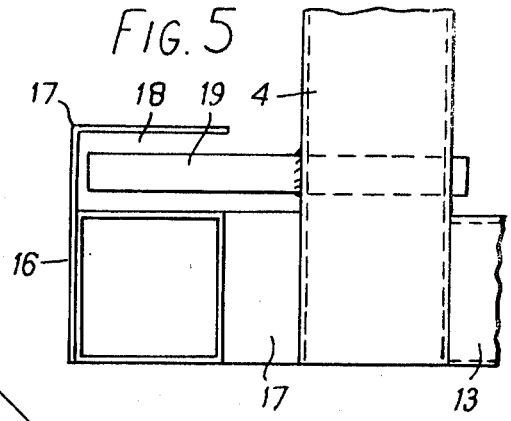
FIG. 5 is an enlarged view of another portion of the structure shown in FIG. 2.

The folding structure shown in FIGS. 1 to 5 is intended to support a counter display unit or other 'working surface' for use in commercial premises, the intention being that the complete unit can be folded away to a small size when not required but at the same time the structure must be rigid to enable it to withstand knocks in commercial use.

As shown in the drawings the structure comprises a first rigid element in the form of an upper frame indicated by reference numeral 1. This frame is rectangular is plan view and has side members 2 and end members 3, the various members being welded together and made from square section metal tubing. Located at each corner of the frame 1 is a folding strut in the form of a leg 4. As is most clearly shown in FIGS. 3 and 4 each leg 4 is connected to one at the side members 2 of the frame 1 by a pivot pin 5, a spacer 6 being interposed between the members to allow sufficient clearance and prevent binding. The upper corner of the leg 4 is chamferred as shown at 7 so that it can be rotated to a position in which it lies in line with the side members 2 of the upper frame 1, the direction of movement being indicated by arrows 8 in FIGS. 1 and 4. The two legs at each end of the frame 1 and the pivot 5 of which are co-axial are interconnected by a connecting member 9 which is welded to each leg at 10 and is of similar square section tubing. As will be seen in FIGS. 3 and 4 the connecting member 9 is displaced somewhat from the pivot pin 5 and it has an upwardly directed abutment surface 11 which engages a downwardly directed engagement surface 12 provided by the lower surface of the end members 3 of the frame 1. It will thus be seen that the connecting member 9 therefore acts as an abutment on the legs 4 and the abutment surface 11 faces in the reciprocal direction to the lengthwise direction of the leg 4 away from the pivot pin 5.

The lower ends of the legs 4 are coupled together by a connecting bar 13 again made of square section tubing.

A second element in the form of a lower frame 15 is also provided and this extends around the lower parts of the legs 4. This frame has side members 16 and end members 17, most clearly shown in FIG. 5. The side members 16 have an overwrapping of angle section metal 17 so that a channel 18 is formed between the section 17 and the square section tubing from which the side members 16 are made, again as is most clearly shown in FIG. 5. The lower end of each leg 4 carries a location pin 19 which extends into the channel 18 and in which it can slide.

In order to raise the structure from the ground when it is assembled the lower end of each leg 4 carries a small adjustable/self-levelling foot 20.

If desired channel stops 21 can be provided in the channels 18, as indicated in FIG. 1. These channel stops provide between them an "unused" centre area and prevent the lower frame sliding in an uncontrolled manner in relation to the upper frame when the structure is collapsed or assembled. The centre area may be utilized for the placement of one or more fitments or features of any kind for use in the practical and varied application of the invention when it is in the folded or in the erected condition.

Figure 11:
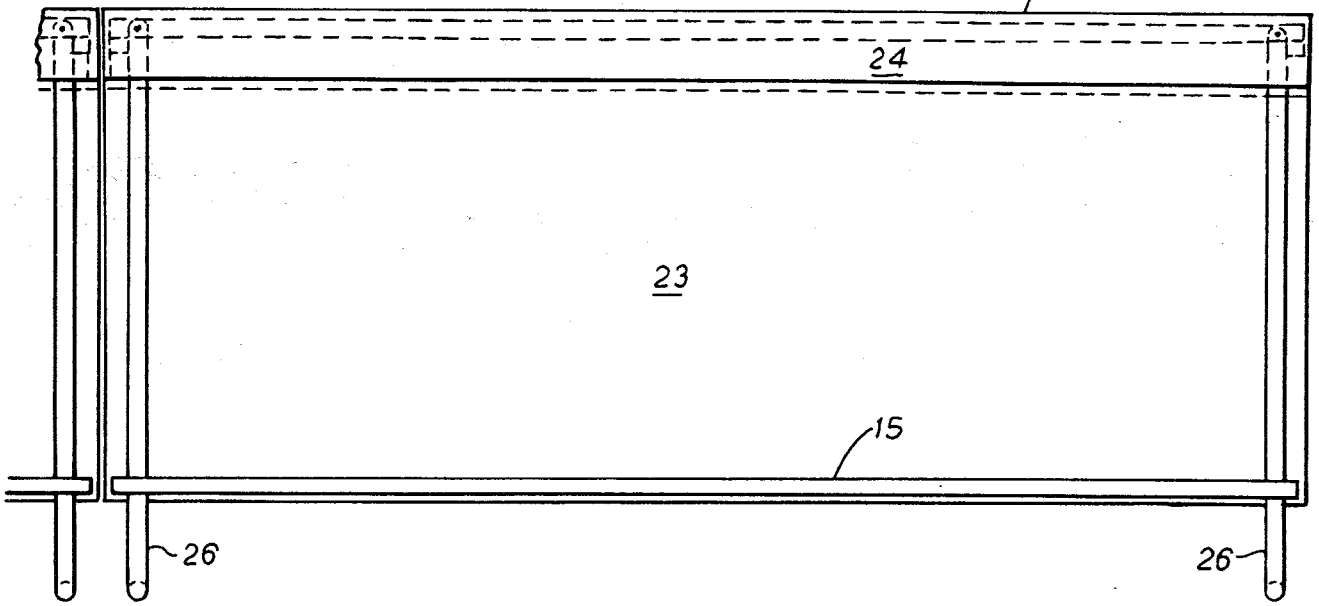
FIG. 11 is a side view of a structure of the kind shown in FIGS. 1, 2 and 3 with an outer covering for a counter.
Figure 12:
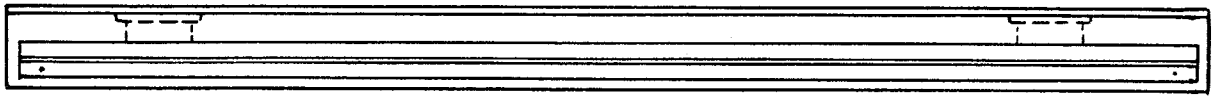
FIG. 12 is a plan view showing the counter in a fold-away position.

A counter utilising a frame similar to that described above is shown in FIGS. 11 and 12. In FIG. 11 it will be seen that the upper frame 1 is provided with a covering 22 and the front of the framework has a covering 23 which is pivoted by hinges, not shown, to the forward edge of the covering 22. In FIG. 11, as in FIGS. 1 and 2, the counter structure is shown with its legs in the extended position and ready for use, and in FIG. 12 it is shown with the legs collapsed and the lower frame 15 tucked within the downwardly extending sides 24 of the upper covering.

In order to hold the framework in the erected position releasable connection means are provided in the form of a screw 25 having a large head and which is carried in a suitable opening in the lower connecting bar 13. When the legs are placed in their extended positions the screws 25 are threaded into tapped holes in the end members 17 of the lower frame and as they engage they pull the connecting bars 13 and lower frame 17 together. This movement therefore pushes the co-operating surfaces 11 and 12 into close engagement so that eventually not only are the two lower members, that is the bar 13 and end member 17 of the frame clamped together but the effect is to clamp the end member 3 and connecting member 9 together through the co-operating surfaces 11 and 12 thus effectively preventing shake in the whole end portion of the structure. This is achieved because of the spaced apart engagement between surfaces the upper and lower portions of the structure and also the transversely spaced apart engagement surfaces which are provided by the ends of the co-operating and engaging surfaces.

When it is desired to fold away the counter it is merely necessary to undo the two screws 25 and fold the legs 4 in the direction as indicated by the arrows 8, as the legs fold inwardly the pins 19 slide along the channels 18 and the lower frame 15 approaches the upper frame 1 until they are close together. The total width of the counter is now merely the distance across these frame members plus any depth of side members such as those shown by reference numeral 24. In the arrangement shown in FIG. 11 the front member 23 is folded over the frame structure once it has been folded away to therefore provide a more or less completely closed article which can be easily transported and stored.

It will be appreciated that the arrangement shown in FIG. 11 the small feet 20 have been replaced by extended legs indicated by reference numeral 26.

Figure 6:
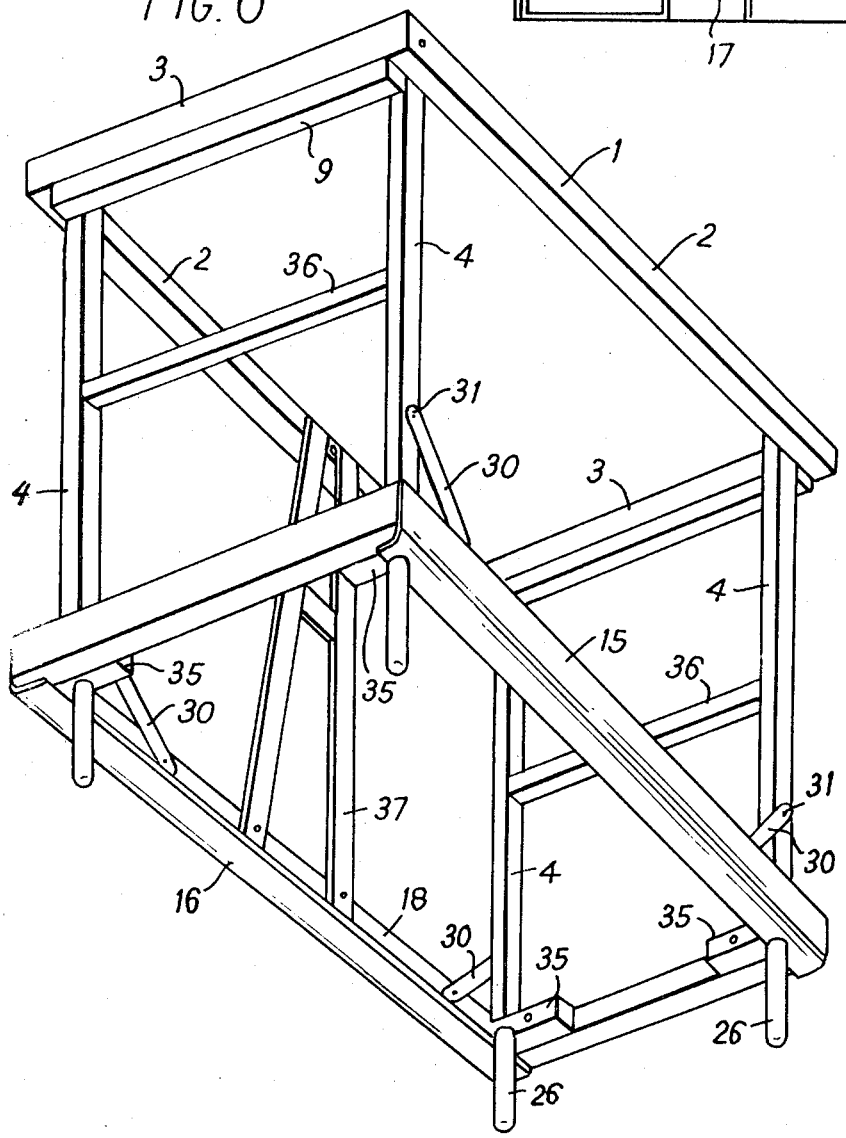
FIG. 6 is an isometric view from beneath showing a counter-structure embodying the invention in the assembled position and embodying safety braces.
Figure 7:
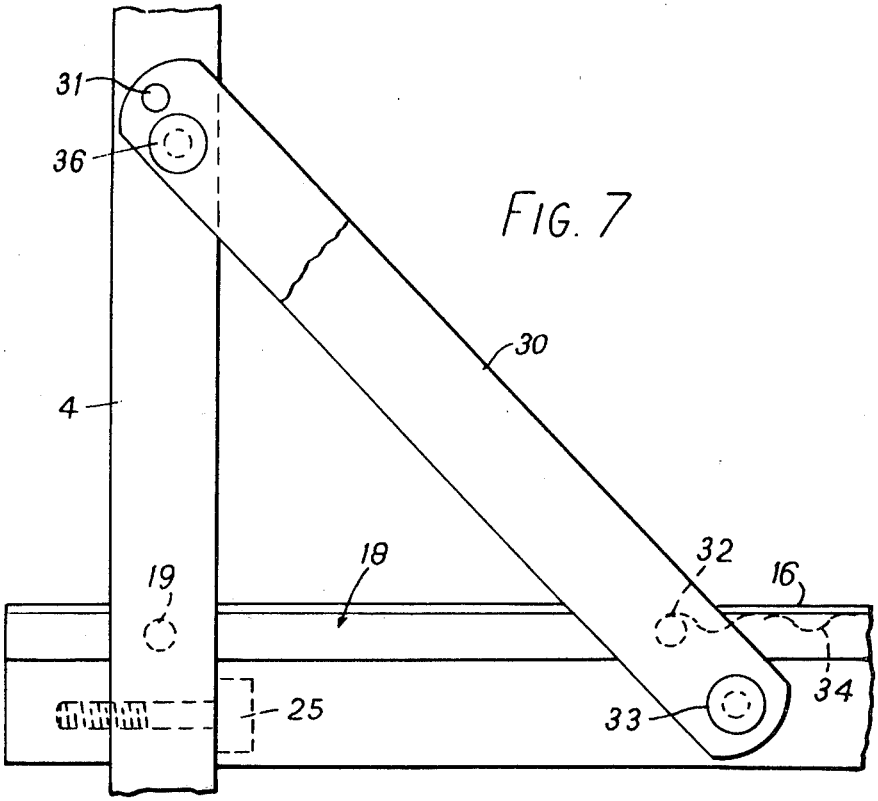
FIG. 7 is a detailed view of the braces used in the construction shown in FIG. 6.

In the structure shown in FIG. 6 the same reference numerals are used to indicate similar parts but in this case the lower ends of the legs 4 carry safety braces 30, each brace being connected by a pivot pin 31 to the appropriate leg. The other end of each brace 30 is provided with a pin 32 which projects into the existing channel 18 in the side members 16 of the frame 15 and this end of the brace is also provided with a knurled finger screw 33, as is best shown in FIG. 7. The upper surface of the channel 18 is provided with a corrugated track 34 of resilient metal which is dimensioned so that when the legs are extended it is necessary to pull the pin 32 over the corrugations and against their resilience. When the fully extended position is reached the knurled finger screw 33 is screwed into a tapped hole, not shown. With this arrangement the lower connecting bar 13 of the arrangement shown in FIGS. 1 and 2 is dispensed with but two location members 35 are provided each having a screw 25. When the legs have been erected therefore and the thumb screw 33 inserted in each safety brace the screws 25 can also be connected to cause the interengaging surfaces to be compressed together to provide the rigidity referred to. As shown in FIG. 6 the connecting bar 13 of FIGS. 1 and 2 is replaced by a securing bar 36 arranged at a mid point in the length of the legs. This bar is intended to provide facilities for the inclusion of drawers or shelving within the structure. Similarly a location frame 37 can also be provided which can form the basis of a drawer or counter supporting arrangement.

It will be appreciated that the invention allows for the formation of complete counter and similar units where internal shelving, front, back and end coverings which can all fold down to within the depth of the skirt surrounding the counter top when not in use.

If desired a further thumb screw 36 can be provided on the braces 30, as shown in FIG. 7 which can screw into a tapped hole in the leg 4 to provide a further safety measure and ensure further rigidity.

Figure 8:
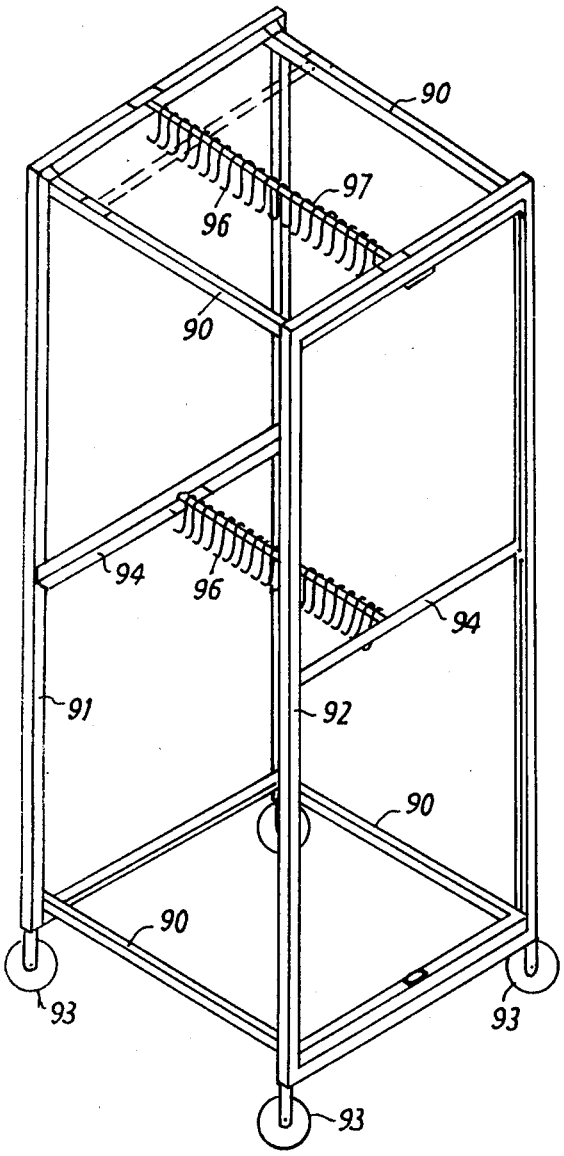
FIG. 8 is an isometric view of a garment hanging device utilising the invention.
Figure 9:
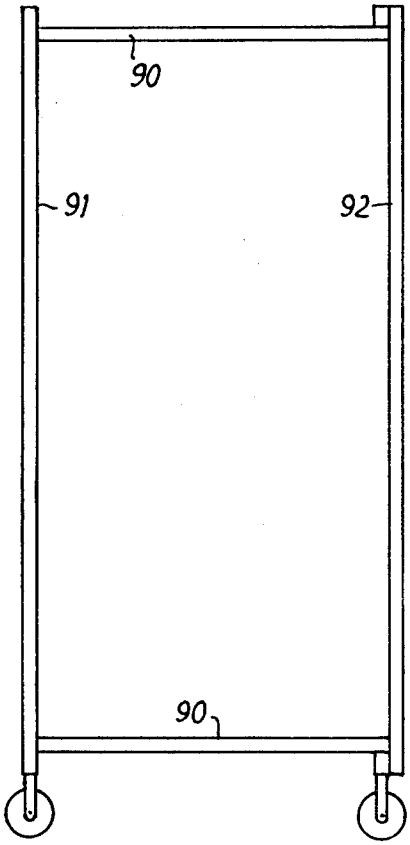
FIG. 9 shows a device extended and retracted.

FIG. 8 shows a fold-away trolley which can be made up from a similar structure to that described with regard to the preceeding figures. In this arrangement however the struts which form the legs now extend horizontally and are indicated by reference numbers 90. The upper and lower frames are now replaced by frames 91 and 92. The lower ends of the frames 91,92 carry small castoring wheels 93 and intermediate members 94 are provided which can act to carry supports 95 from which hooks 96 can hang to support merchandise. It will be seen that there is an upper support 97 with similar hooks 96 so that two rows of garments can be supported. A trolley of this kind can be used by the garment industry for rapid movement of garments about factories and other premises and in vehicles and when it is not required the structure can be rapidly collapsed to a small shape as shown on the left hand side of FIG. 9 thus allowing storage of large numbers of such storage racks.

The constructional details of this garment hanging merchandise rack are substantially the same as described with regard to structures for supporting a counter but if desired the upper folding struts 90 could be of shorter length than the lower struts so that the dimensions of the assembly taper upwardly to provide a more stable structure.

Figure 10:
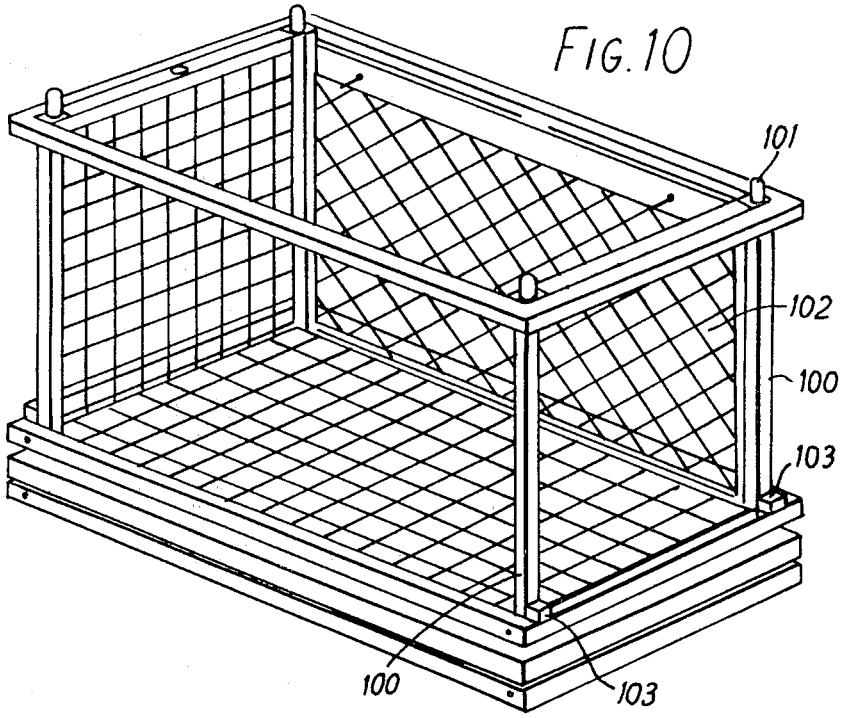
FIG. 10 shows an isometric view of a collapsable container utilising the structure.

FIG. 10 shows a fold-away container which is made up from a similar structure but in this case the projecting ends of the folding struts 100 act as location pegs 101 for container placed above them. Removable or hinged sides 102 can be provided which can be solid or of an open structure as shown. In this construction however the connecting member 9 of FIGS. 1, 2 and 3 is replaced by providing merely a projecting lug 103 on each folding strut. This will provide the necessary stiffness in the structure because the rigidity previously provided by the connecting member 9 is now provided by the inserted side 102. As shown in FIG. 10 the collapsed containers are of shallow depth and a collapsed container is shown in position beneath the erected container.

Figure 13:
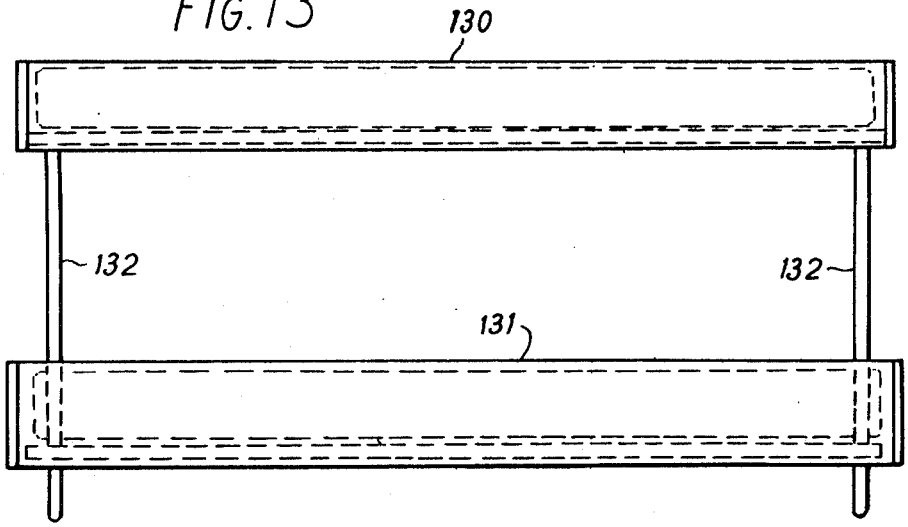
FIG. 13 is a side elevation showing the structure used in a bed construction to provide a framework for two bunks which can be folded away to a reduced size.
Figure 14:
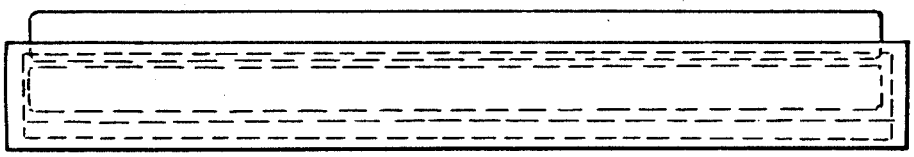
FIG. 14 is a side elevation of the bed shown in FIG. 13 in a collapsed position.

FIGS. 13 and 14 show a double bunk or bed unit utilising the structure as shown in FIGS. 1, 2 and 3. Details from the structure are not shown but it will be appreciated that the upper bed is in the form of an open box secured to the upper frame 1 and the lower bed is in the form of an open box 131 secured to the lower frame. The upper box is of slightly smaller dimensions than the lower box and room is left along the sides of the lower box to allow the legs 132 to be folded upwardly when the unit is collapsed. In this way it is possible for the upper bed 130 to be housed within the lower bed 131 to produce a structure as shown in FIG. 14 which can be used as a sofa and erected at night for use as two beds.

It will be appreciated that the invention can be applied to many of the devices used in the transportation and distribution fields on the fact that a structure can be delivered in its collapsed state and subsequently erected has many advantages. The fundamental advantage of the present invention over previous suggestions in this field is that the present invention allows for the structure to be substantially rigid, and requiring no loose or "losable" parts in the basic structure.

The structure may be used as the basis of racking, and affixed to floors or walls of goods vehicles or containers or it can be free standing and each rack is emptied of its load it can be folded to create more space in the vehicle or the container concerned, and complete freedom if 'walk-through' inside the vehicle as the load diminishes.

The construction of the structure also facilitates protection for the contents held within it. Thus in a framework made up from the structure in which articles, such as garments are hung a shrink wrapping or polythene sleeving may be applied to completely seal-in and to protect the articles and in this way high value merchandise, whether shelved, stacked or hanging can be protected and restrained in position throughout all the transportation and distribution thereof and without the fear of the structure collapsing.

As mentioned with regard to FIG. 10 it is possible for containers using the structure to be fitted with interstacking tabs or posts which allow them to be stacked one above the other during transport or storage, or for the structure to be used as the fundamental construction factor of individually utilised collapsable heavy-duty and lighter weight freight containers which are fully clad on the exteriors. In this area the substantial construction of the frame can be utilised, with appropriate in-built fixings on the frame, as the means of 'suspension' for intricate/delicate machinery to avoid/eliminate shock/vibration in transit.

Moreover the structure could be used as a display structure, for example for use in advertising purposes or displaying merchandise.

Small containers made up using the structure can be employed individually or collectively as trolleys or mobile benches with two or more interattached for use when making up trolleys, benches and other units of different heights as required. As each bin or container is removed to a particular outlet on, for example, a retail sales floor then the contents can be removed from it and the container collapsed ready for collection.

With the constructions as described, especially with regard to that shown in FIGS. 1, 2 and 3 a two hands approach is necessary to erect the structure or to fold it. This is a safety factor. The arrangement is such that if one end of the structure is forced to the fully folded position the other end will not accidentally fold by itself beyond a predetermined closure point unless deliberately manipulated due to the inherent friction of the pins in the channel 18.

The invention may be utilised in a multitude of applicational uses over the wide spectrum of Industrial and Commercial needs - and in a variety of weights and dimensions according to the job requirement.

The structure may be utilised with any of its 3 dimensions as the base and adapted for many purposes with added features, and particularly so in the areas of transportation/distribution.

Figure 15:
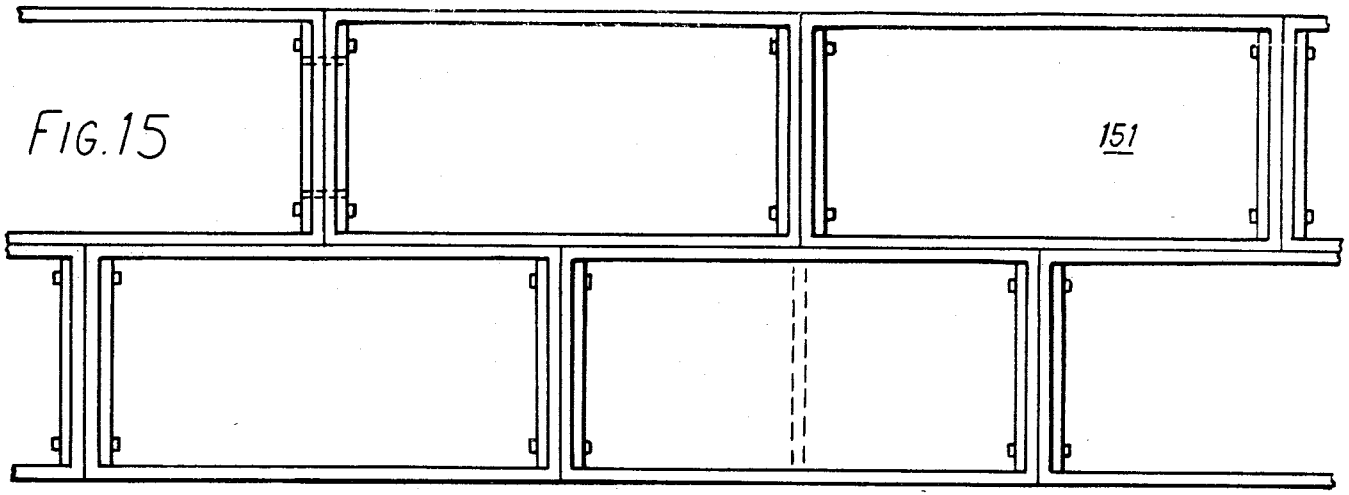
FIG. 15 is a side elevation showing a number of structural assemblies according to the invention used in the form of modular building construction.

FIG. 15 shows how a number of assemblies according to the invention can be made up for use as building members. Thus each module, indicated by reference numeral 151 could be clad with suitable material and used in the manner of a building element. Such a structure could be taken to pieces and the assemblies collapsed for storage. Again, the modules themselves could be large enough to provide whole rooms and thus a multistory structure could be made by placing the modules on top of one another as shown in FIG. 15, each module having an appropriate door, cladding and windows (not shown).

Figure 16:
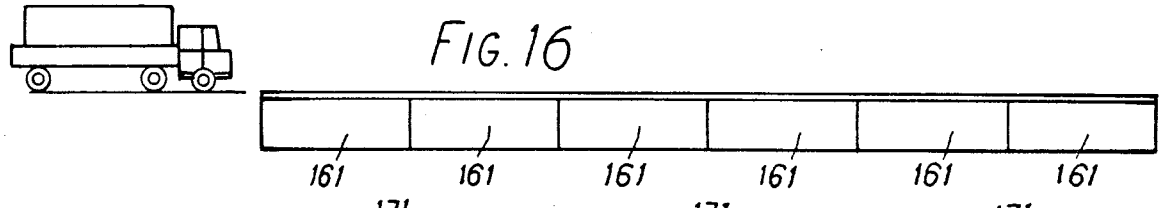
FIG. 16 shows how a number of assemblies according to the invention can be used for the construction of a temporary or permanent roadway.

FIG. 16 shows another use of the assembly as a building element. In this case each element is indicated by the reference numeral 161 and a number are connected together to form the support structure of a bridge. Due to the particular construction of the assemblies they can be easily rigidly secured together to form, in effect a girder.

Figure 17:
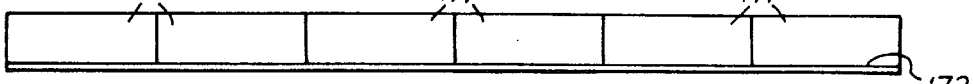
FIG. 17 shows how the assemblies can be used as a bridge.
Figure 18:
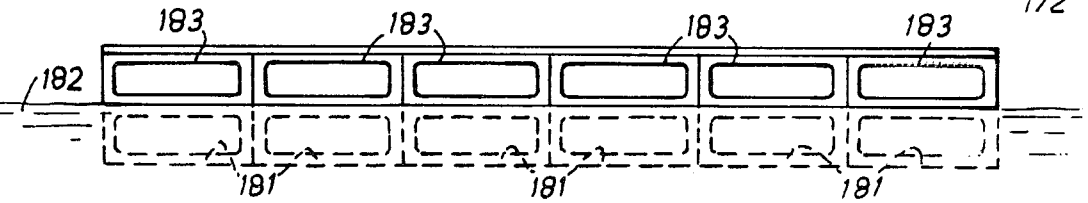
FIG. 18 shows how a water crossing can be constructed using two layers of assemblies according to the invention.

FIG. 17 shows how such a girder made up from assemblies 171 could be used as a girder type bridge, the road surface of the bridge being along the bottom of the girder as indicated by reference numeral 172. FIG. 18 shows how a lower row of assemblies 181 could be placed in a river bed, the river banks being indicated by reference numerals 182. These lower assemblies would act as supports for a row of upper assemblies 183 which again form, in effect, a bridge, the lower or upper surface of the assemblies being appropriately covered to form the road surface.

In FIGS. 16, 17 and 18 the collapsable assemblies could be carried to the site and errected as required, a number of such assemblies being easily carried on the back of a large vehicle is their collapsed condition. Such a bridge or water crossing could be retained as a permanent structure or, due to the particular construction of these assemblies be removed and collapsed as desired.

Figure 19:
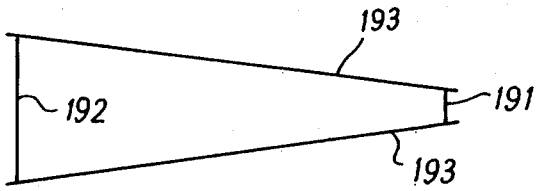
FIG. 19 is a plan view of a collapsable marine craft employing the assembly in an extended position.
Figure 20:
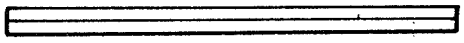
FIG. 20 is a side view of the marine craft.
Figure 21:
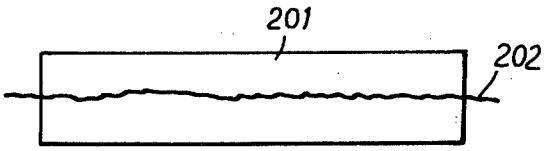
FIG. 21 is a plan view of the collapsed marine craft shown in FIGS. 19 and 20.

FIG. 19 shows another assembly according to the invention which can be used as a marine craft. One end 191 of the assembly is made shorter than the other end 192 so that when the assembly is errected the sides 193 are inclined. With the assembly suitable clad the end 191 can act as a bow for the marine craft. FIG. 20 shows the craft 201 floating in water, indicated by reference numeral 202 and FIG. 21 is a plan view of the craft collapsed. It will be appreciated that the sides of the structure will be suitably covered and compressable material can be provided between the joints for waterproofing purposes.

Again, such craft could be easily carried by a truck and errected as required.

I claim:

1. A collapsible structure comprising first and second pairs of spaced folding struts, each folding strut having one end which is pivoted to a first rigid element to enable each of said struts to be rotated from a retracted position to an extended position, said struts being located at opposite ends of said rigid element, said struts each having an abutment surface spaced away from its associated pivot and extending in a plane substantially parallel to the pivot axis thereof, each said abutment surface being provided on an abutment projecting from an associated strut, each said abutment surface being shaped to engage a cooperating engagement surface carried on said rigid element to locate said struts in their extended positions, releasable means for forcing said abutment surfaces and cooperating engagement surfaces to be held in contact with each other in the extended positions of said first and second pairs of spaced folding struts, a rigid connecting member extending between the struts of each pair of struts on which said abutment surfaces for said pairs of struts are formed, a portion of each rigid element extending between said pivots being shaped to provide said engagement surface for cooperation with the abutment surfaces, said abutment surfaces on said connecting member face in a direction substantially normal to the lengthwise direction of the struts away from the pivots, said rigid elements being part of a polygonal frame having at least four corners with a strut at each corner and being pivoted thereto by an associated pivot, the axes of pairs of pivots being coaxial, a second rigid element spaced from said first rigid element and being disposed adjacent another end of each of said struts remote from said strut one ends, means for connecting said strut another ends to said second rigid element through slidable connections therebetween, and said releasable means being disposed between said second rigid element and said strut another ends for rigidly connecting the same together when said pair of struts are in their extended positions.

2. The collapsible structure as defined in claim 1 including a connecting bar coupling together said another ends of each of said pair of struts.

3. The collapsible structure as defined in claim 1 including a connecting bar coupling together said another ends of each of said pair of struts, and said releasable means being disposed between each of said connecting bars and said second rigid element.

4. The collapsible structure as defined in claim 1 including a connecting bar coupling together said another ends of each of said pair of struts, said releasable means being disposed between each of said connecting bars and said second rigid element, and said releasable means including a threaded fastener.

5. The collapsible structure as defined in claim 1 including an angularly disposed brace pivotally connected between at least said another ends of a strut of each of said first and second pair of struts and said second rigid element.

6. The collapsible structure as defined in claim 1 wherein said slidable connections are defined by channel means of said second rigid element slidably receiving therein pin means carried by at least one of said another ends of each of said first and second pair of struts.

7. The collapsible structure as defined in claim 1 wherein said slidable connections are defined by channel means of said second rigid element slidably receiving therein pin means carried by at least one of said another ends of each of said first and second pair of struts, and said pin means have axes disposed generally parallel to the pivot axes of said struts.

8. The collapsible structure as defined in claim 1 wherein said slidable connections are defined by channel means of said second rigid element slidably receiving therein pin means carried by at least one of said another ends of each of said first and second pair of struts, said pin means have axes disposed generally parallel to the pivot axes of said struts, and said pin means project outboard of their associated struts.

9. The collapsible structure as defined in claim 1 including an angularly disposed brace pivotally connected between at least said another ends of a strut of each of said first and second pair of struts and said second rigid element, and a sliding connection between said brace and said second rigid element.

10. The collapsible structure as defined in claim 1 including an angularly disposed brace pivotally connected between at least said another ends of a strut of each of said first and second pair of struts and said second rigid element, a sliding connection between said brace and said second rigid element, and resilient stop means between said brace and said second rigid element which can be manually overridden when the associate strut is extended but which will retain it in intermediate positions if required.

11. The collapsible structure as defined in claim 2 including an angularly disposed brace pivotally connected between at least said another ends of a strut of each of said first and second pair of struts and said second rigid element.

12. The collapsible structure as defined in claim 2 wherein said slidable connections are defined by channel means of said second rigid element slidably receiving therein pin means carried by at least one of said another ends of each of said first and second pair of struts.

13. The collapsible structure as defined in claim 2 wherein said slidable connections are defined by channel means of said second rigid element slidably receiving therein pin means carried by at least one of said another ends of each of said first and second pair of struts, and said pin means have axes disposed generally parallel to the pivot axes of said struts.

14. The collapsible structure as defined in claim 2 wherein said slidable connections are defined by channel means of said second rigid element slidably receiving therein pin means carried by at least one of said another ends of each of said first and second pair of struts, said pin means have axes disposed generally parallel to the pivot axes of said struts, and said pin means project outboard of their associated struts.

15. The collapsible structure as defined in claim 3 including an angularly disposed brace pivotally connected between at least said another ends of a strut of each of said first and second pair of struts and said second rigid element.

16. The collapsible structure as defined in claim 3 wherein said slidable connections are defined by channel means of said second rigid element slidably receiving therein pin means carried by at least one of said another ends of each of said first and second pair of struts.

17. The collapsible structure as defined in claim 3 wherein said slidable connections are defined by channel means of said second rigid element slidably receiving therein pin means carried by at least one of said another ends of each of said first and second pair of struts, and said pin means have axes disposed generally parallel to the pivot axes of said struts.

18. The collapsible structure as defined in claim 3 wherein said slidable connections are defined by channel means of said second rigid element slidably receiving therein pin means carried by at least one of said another ends of each of said first and second pair of struts, said pin means have axes disposed generally parallel to the pivot axes of said struts, and said pin means project outboard of their associated struts.

* * * * *